US006081198A

United States Patent [19]

Adamson et al.

[11] Patent Number: 6,081,198

[45] Date of Patent: Jun. 27, 2000

[54] METHOD AND APPARATUS FOR COMMUNICATION IN AN ELECTRIC FENCE WIRING SYSTEM

[75] Inventors: Paul Robert Adamson, Wellington; Ross Richard Nilson, Palmerston North; John Reginald Spray, Auckland, all of New Zealand

[73] Assignee: Tru-Test Limited, Auckland, New Zealand

[21] Appl. No.: 09/070,749

[22] Filed: May 1, 1998

[30] Foreign Application Priority Data

May 2, 1997 [NZ] New Zealand ..... 314735

[51] Int. Cl.[7] ..... G08B 21/00

[52] U.S. Cl. ..... 340/660; 324/527; 340/573.2; 340/661; 375/239; 702/64

[58] Field of Search ..... 340/660, 661, 340/663, 573.2, 870.19, 825.64, 561, 564, 541; 341/143; 375/239, 244; 324/71.1, 103 R, 527; 702/57, 64, 79

[56] References Cited

U.S. PATENT DOCUMENTS

| | | | |
|---|---|---|---|
| 4,297,633 | 10/1981 | McCutchan et al. | 324/527 |
| 4,523,187 | 6/1985 | Begg | 340/661 |
| 4,725,825 | 2/1988 | McKean | 340/660 |
| 4,771,245 | 9/1988 | Woodhead | 340/649 X |
| 5,396,447 | 3/1995 | Suntken | 364/841 |
| 5,420,885 | 5/1995 | May | 375/239 |
| 5,596,281 | 1/1997 | Eriksson | 340/660 X |
| 5,771,147 | 6/1998 | Eriksson et al. | 340/649 X |

FOREIGN PATENT DOCUMENTS 238176 5/1991 New Zealand .

*Primary Examiner*—Thomas Mullen
*Attorney, Agent, or Firm*—Young & Thompson

[57] ABSTRACT

A method of sending a communication signal. The method includes the step of using a pulse density modulated signal in an electric fence. The method is particularly useful for communication on an electric fence wiring system. The complete signal can be formed from the sum of a number of transmissions from a responder to a receiver over a period defined by a number of pulses from an electric fence energizer coupled to the electric fence wiring system.

25 Claims, 6 Drawing Sheets

METHOD AND APPARATUS FOR COMMUNICATION IN AN ELECTRIC FENCE WIRING SYSTEM

BACKGROUND OF THE INVENTION

1. Discussion of the Background

This invention relates to a method of communication and more particularly but not exclusively a method of communication on an electric fence wiring system.

2. Description of the Related Art

Electric fence systems are widely used for agricultural fencing primarily to contain stock, but also to keep out predator animals from stock containing areas. All electric fence relies on a short pulse of high voltage and energy to deter animals. The fence, however, becomes more of a psychological barrier than a physical barrier. To achieve the desired end result the voltage of the pulse of the electric fence must be maintained at a level which will deter animals under all fence conditions. Therefore, if a fence is overloaded due to vegetation growing and resting on the fence, or if part of the fence is damaged, animals could learn. that the voltage/energy of the pulse is degraded and subsequently push through the fence.

There is therefore a need to measure and monitor the voltage on an electric fence system.

SUMMARY OF THE INVENTION

The object of the present invention is to provide a method of communication which is particularly suited for communication on an electric fence wiring system whereby the condition of the electric fence wiring system can be monitored.

Broadly, according to one aspect of the invention there is provided a method of sending a communication signal along an electric fence wiring system characterized by the step of using a pulse density modulated signal.

According to a further broad aspect of the invention there is provided a method of communication on an electric fence wiring system wherein a complete signal is formed from the sum of a number of transmissions from a responder to a receiver over a period defined by a number of pulses from an electric fence energizer coupled to the electric fence wiring system.

Preferably the method according to the invention provides a means of monitoring the condition of an electric fence wiring system by determining from the complete signal and the number of pulses taken to transmit the signal the average voltage over the period during which the signal was transmitted.

According to yet a further broad aspect of the invention there is provided a method of communicating on an electric fence wiring system incorporating an electric fence energizer, the method comprising the steps of transmitting a complete signal during a period of time and determining a quantity derived from the signal and number of pulses during the time period.

The present invention also broadly provides apparatus for transmitting a communication signal along an electric fence wiring system by the use of a pulse density modulated signal.

DESCRIPTION OF THE PREFERRED EMBODIMENT

Figure 10:
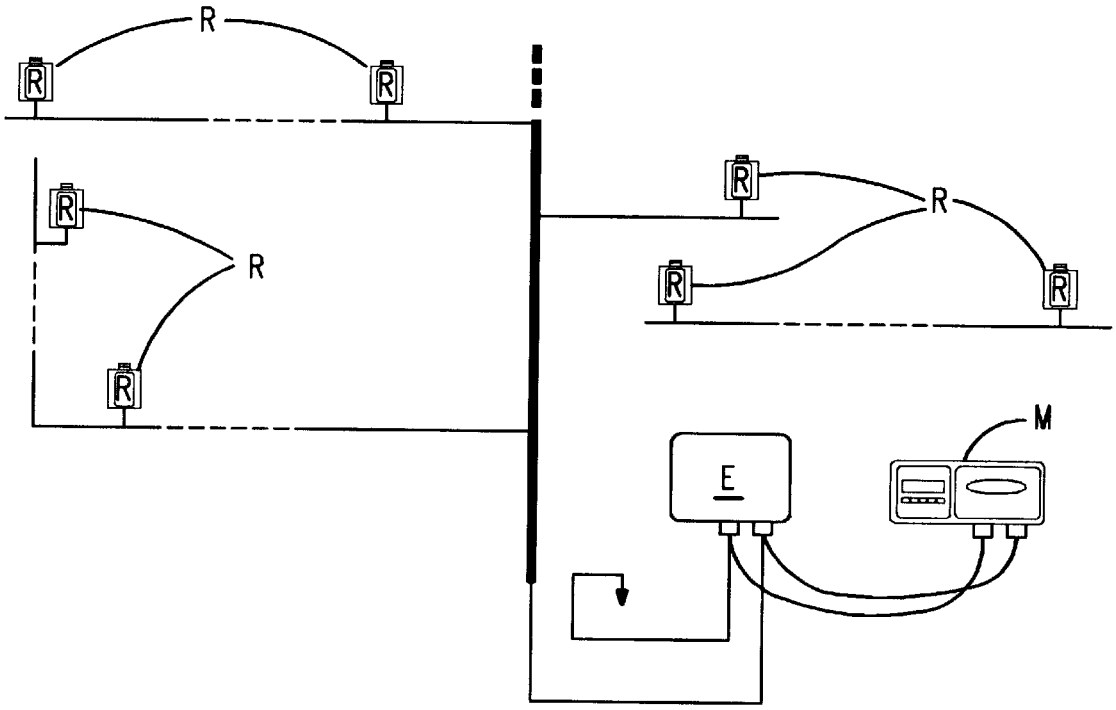
FIG. 10 is a schematic illustration of an electric fence of typical known construction incorporating the present invention.

FIG. 10 illustrates a typical electric fence system having an electric fence energizer E and wiring to which the energizer E is coupled in a typical earth-return connection.

According to the present invention the method of communication and apparatus for carrying out the method employs a receiver or master unit M attached to the fence and one or more slave units or responds attached to the fence line at various points that need to be monitored. The master unit M is used to indicate a voltage measured at the or each slave unit R.

The slave units R are preferably powered from the fence pulse from energizer E and the transmissions from different slave units are timed to occur at different times (or time slots) between successive electric fence energizer pulses. Each slave unit R captures a small amount of energy from each energizer pulse via a step-down transformer and temporarily stores most of the energy in an inductor. This energy is then transferred to a capacitor which acts as a long-term energy store and provides energy to the slave's electronic circuitry as required.

Figure 8:
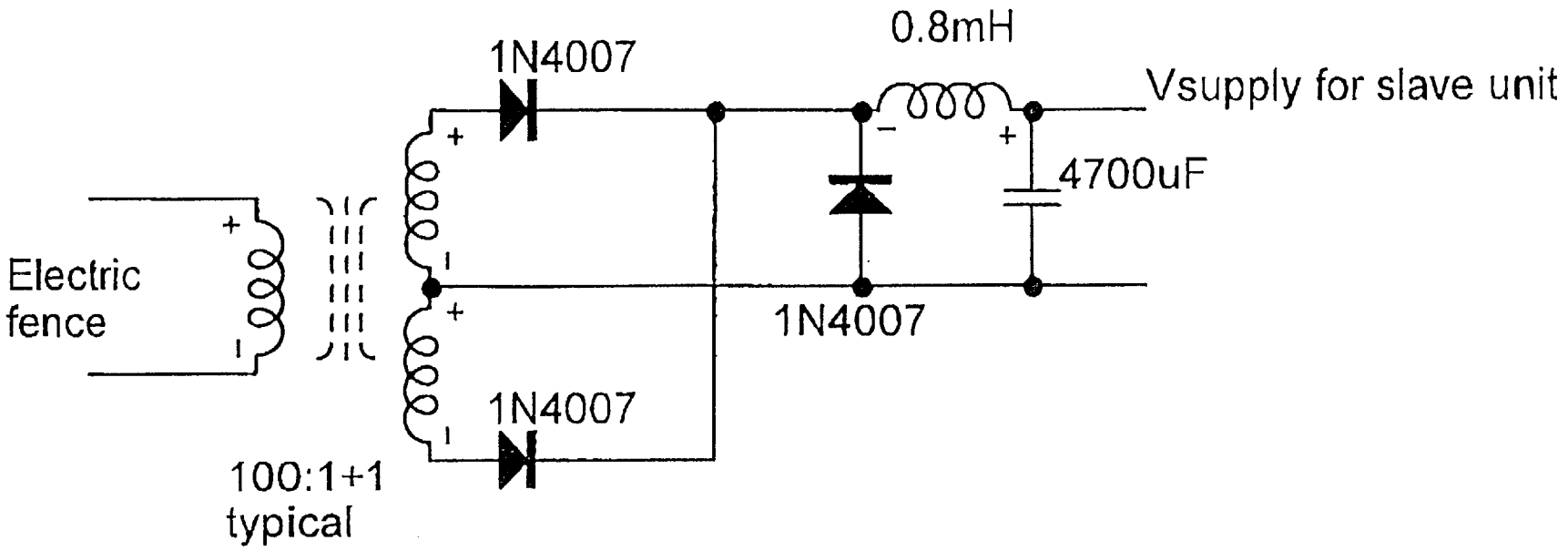
FIG. 8 is a circuit diagram of circuitry intended to permit a slave unit to operate with an electric fence energizer.

A circuit arrangement that allows the slave unit to operate with energizers producing either a largely positive or negative voltage pulse is shown in FIG. 8.

According to the present invention, above a certain level of peak voltage that still exceeds the minimum useful animal deterrent voltage, a slave unit is only required to transmit a response signal when the slave unit has captured enough energy to do so. This is so because the energy that the slave unit is designed to capture for each energizer pulse will increase somewhat more than linearly as the peak voltage of the energizer pulse at each slave unit increases, for a given pulse shape and minimum duration above a threshold. At the same time the corresponding average period between transmissions will decrease, but only in an inverse linear fashion. Hence, the slave unit will always have enough energy to transmit if the peak voltage at the slave unit remains above a certain level, for a given pulse shape and minimum duration above a lower threshold.

According to the present invention, the slave unit sums up the peak voltages of energy pulses until a threshold value is reached at which point a response signal is therefore transmitted from the slave unit to the master unite The slave unit has at least enough energy to transmit yet remain "alive".

In the interests of energy efficiency/conservation, minimum transmission attenuation on the fence line and ease of discrimination at the master unit, each slave unit is arranged such that during its time slot when a response signal must be transmitted it will transmit a short tone burst. In the preferred arrangement the tone burst is transmitted at an optimal audio frequency common to all slave units.

A decoding device is incorporated in the master unit. This enables the master unit to determine how many times each slave unit has responded within a known number of fence pulses. It can thereby determine the peak voltage on the fence at each slave unit to enable the condition of the fence at that point to be monitored.

Figure 1:
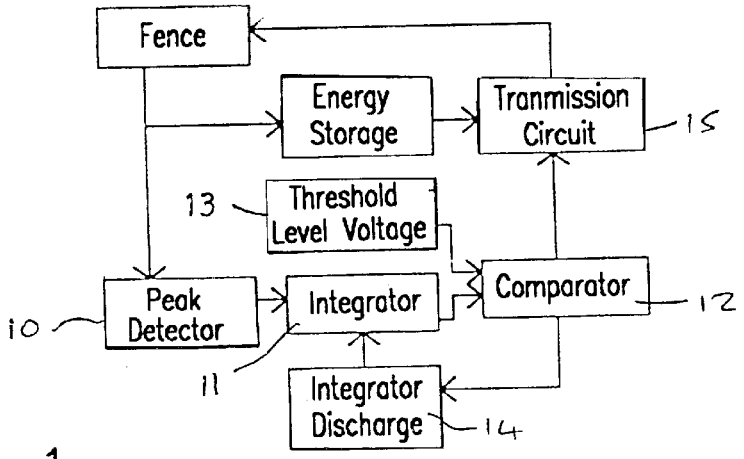
FIG. 1 is a schematic block illustration of the slave unit according to the invention.

Referring to FIG. 1 of the drawings, the communication method according to the present intention is illustrated. The communication method is brought into effect using electronic hardware and embedded software in the slave unit.

As shown, the peak detector 10 receives and holds the peak pulse voltage in hardware and then in software. This voltage (or more particularly a scaled version of it) is added to a peak voltage sum stored in the integrator 11. Upon receipt of a next incoming pulse the integrator voltage (software variable) is compared through comparator 12 to the threshold level voltage 13 which is a constant value held in software. If higher than the threshold the comparator 12 then triggers the integrator discharge (software) 14 in order to subtract the threshold voltage level from the integrator 11 and advises the transmission circuitry 15 to transmit a response signal back through the fence line to the master unit.

The integrator 11 and integrator discharger 14 are implemented in software in order to save hardware costs and also to provide a more precise subtraction of the threshold voltage from the integrator each time a response signal is transmitted.

Figure 2:
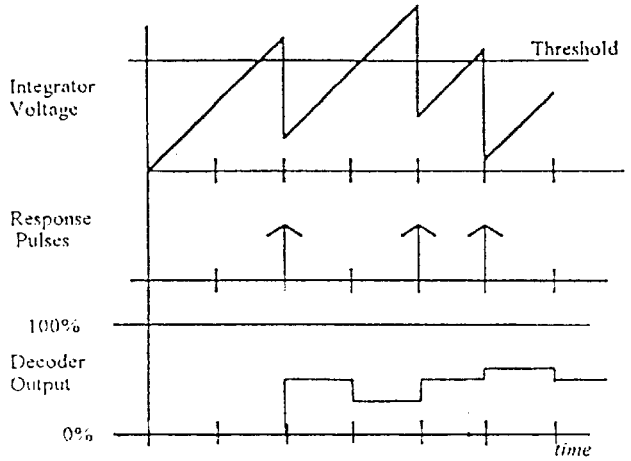
FIG. 2 is a graphical illustration of transmissions from a slave unit for a given peak fence voltage.

The decoder device in the master unit can multiply the threshold voltage by the number of positive responses and divide by the number of energizer pulses in order to obtain the average voltage on the fence during the summation period. Accordingly, FIG. 2 illustrates that a slave unit has transmitted three times in six energy pulses and given the decoder device an output of 50% at the end of the six pulses. The actual input voltage to the integrator in FIG. 2 is 60% of the threshold voltage which the decoder will eventually output as more pulses are viewed by the decoder.

While the method described above has the advantage that it is simple and output pulses are related to the energy available, there is, however, a trade-off between response time and accuracy of measurement.

Thus, if for example an output is determined for five pulses and if the fence voltage is less than 20% of the threshold value then after five pulses the slave unit will not have responded. The decoder means will therefore output 0% of the threshold value while, as mentioned above, the voltage could be almost as high as 20% of the threshold value. This therefore corresponds to a maximum error of 20%. Thus, generalising for n pulses used to determine an output of the decoder means the maximum error for the method as described above is 1/n.

In order to increase the accuracy of the communication method, n should be as large as possible. Also, in order to minimize the absolute error, the threshold voltage should be as low as possible provided that for the maximum peak voltage that needs to be resolved the device will not respond every pulse.

Accordingly, if n is not large compared to the average number of pulses between two responses, then the output of the decoder means will be seen to fluctuate wildly around the correct value. For example, consider the last ten pulses tested (n=10), a threshold value of 50 kV and an average peak voltage of 7 kV. For any ten pulses there could be either one or two responses indicating either 10% (5 kV) or 20% (10 kV) of the threshold value. Should the fence voltage drop below 5 kV the decoder may not even respond at all. These errors are still a maximum fraction of 1/n of the threshold value.

To deal with this lack of accuracy the present invention provides that the pulse count is only started directly after a transmission from the slave unit. The count is determined on the last pulse in which there was a slave unit transmission even if this is not the last pulse tested. This energizer pulse count (m) is less than or equal to the number of pulses tested (n). The decoded output is then found by dividing the number of positive transmissions (p) of the slave unit by the energizer pulse count (m) and multiplying by the threshold value.

Therefore, in the previous example with the threshold value of 50 kV and n=10, the gap between the two successive pulses (m) would be either seven or eight pulses. Thus, if there was a pulse in the slot just before the receiver happened to start counting, the gaps after the last response would be ignored. Thus, values of m=7 or m=8 would be used, giving coded values of 7.1 kV or 6.25 kV respectively. For a large value of n the decoder output would tend towards a voltage of 7 kV.

Accordingly, the maximum error will occur when the pulse count response rate is maximum—the error is then 1/n as it was in the earlier described method. However, if the response rate is lower than the maximum, the absolute error is reduced significantly. If p is the number of positive responses for m energizer pulses then the maximum error is given by the equation:

$$\text{maximum absolute error} = \frac{p}{m-1} - \frac{p}{m}$$

$$(p \text{ always} < m,\ m < \text{or} = n)$$

Figure 3:
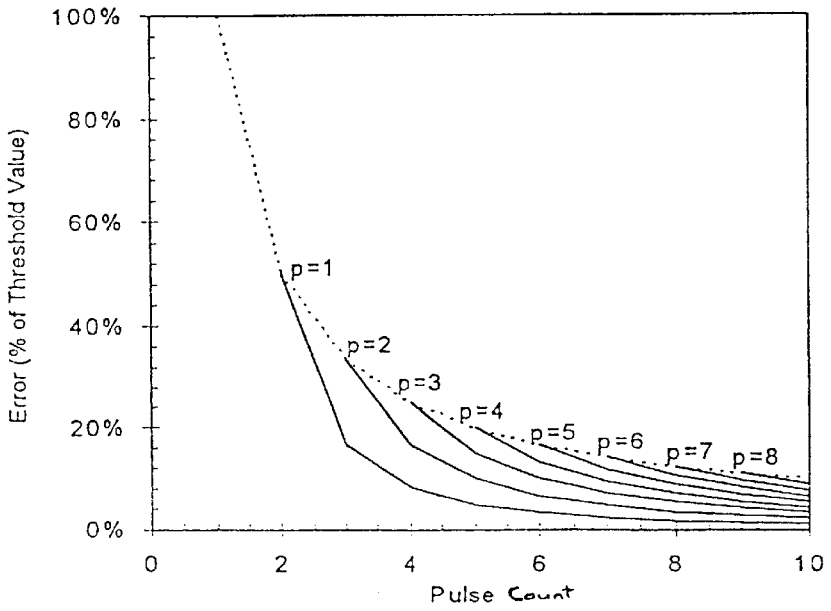
FIG. 3 is a graphical illustration of error reduction arising from an improved method of decoding a pulse density modulated signal according to the present invention.

FIG. 3 of the drawings provides an example of this error reduction. It should be noted that error for the 100% transmission rate would indicate a voltage greater than the threshold value. Thus, to ensure complete confidence in the maximum error the threshold value should be set higher than the maximum electric fence peak voltage level. The dotted line in FIG. 3 represents 1/n. The solid lines show the errors, now dependent upon the number of positive responses, for the improved method as described above.

As a consequence the error is no longer a percentage of the threshold value, but rather a percentage of the decoder output. For example, in the case where m=n=10, the error becomes 11% (⅛th) of the decoder output, rather than 10% of the threshold value. Thus, when the voltage is 10% the error has improved from 10% of the threshold value to 1.1% of the threshold value. For the case where m<n, the error increases as m decreases, however m will never be less than n/2, thus the improved calculation method will never respond with an error worse than the earlier described method.

Although this enhancement of the basic method according to the invention is an improvement, a corresponding improvement to the decoder is required. Consequently, the decoder must be able to divide by a variable number for m, as m could range from n down to n/2. Also the decoder unit must recommence counting for each slave unit only after a pulse is received from that slave unit.

In order that the slave unit transmissions can be distinguished from noise on the fence line a filter is required in the master unit. This filter is tuned to the slave transmission frequency. In the preferred form the filter's centre frequency is in the range 273 Hz to 277 Hz so that system sensitivity to harmonics of 50 Hz or 60 Hz mains is minimized, and the filter bandwidth is made narrow enough to reject these harmonics.

The filter must be able to detect 273 Hz slave transmissions with an amplitude less than 50 mV and must be able to withstand variations in amplitude of received transmissions from different slave units of at least ten times. The filter must also block mains pickup of both 50 Hz and 60 Hz of up to 100 V peak to peak, along with the harmonics of these mains frequencies. The two closest harmonics to 273 Hz are 250 Hz and 300 Hz. If the 250 Hz harmonic is assumed to have a maximum amplitude of 5 V peak to peak, this implies 5% of the fundamental amplitude for the fifth harmonic, which is considered very much a worst case scenario.

The filter must block and be able to withstand the energy pulse itself. The bulk of the pulse energy of the energizer is generally found to be in the 10 kHz region in the frequency domain. The filter must also allow timing distinctions of the signals that it passes. This ensures correct identification of slave unit time slots.

Figure 4:
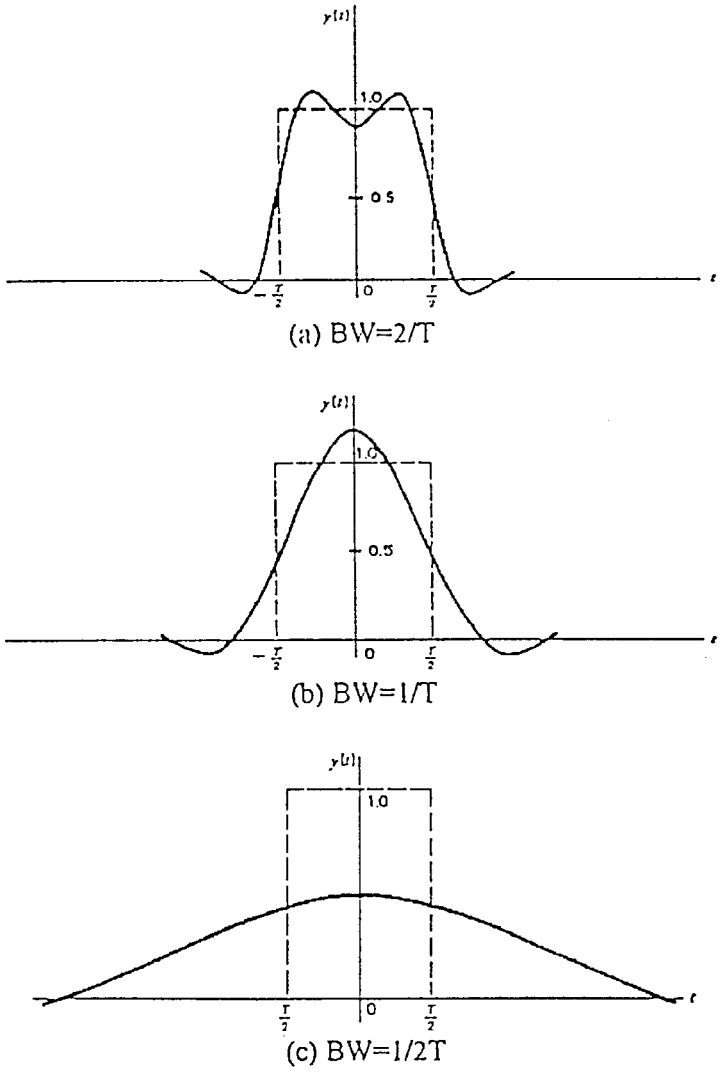
FIG. 4 is a graphical illustration of filter response in the time domain as a function of filter bandwidth.

In order for the filter to detect a tone burst in a time slot, the bandwidth of the filter should be at least as large as the inverse of the length of the time slot. Thus, for example, in FIG. 4 the relationship between filter bandwidth and signal duration is shown by illustrating the envelope of the filter output. It should be noted that for the bandpass filter the true output would be the envelope multiplied by cosine($2\pi ft$).

Assuming that the duration of the 273 Hz frequency bursts are of 1/17th second each the bandwidth of the filter must be at least 17 Hz. This is possible as there is a 50 Hz band gap for the filter from 250 Hz to 300 Hz. However, a series of simple bandpass filters all tuned to 273 Hz with an attenuation of 34 dB at 250 Hz (which would attenuate a 5 V peak to peak 250 Hz signal to 100 mV peak to peak) does not allow a 17 Hz bandwidth.

Figure 9:
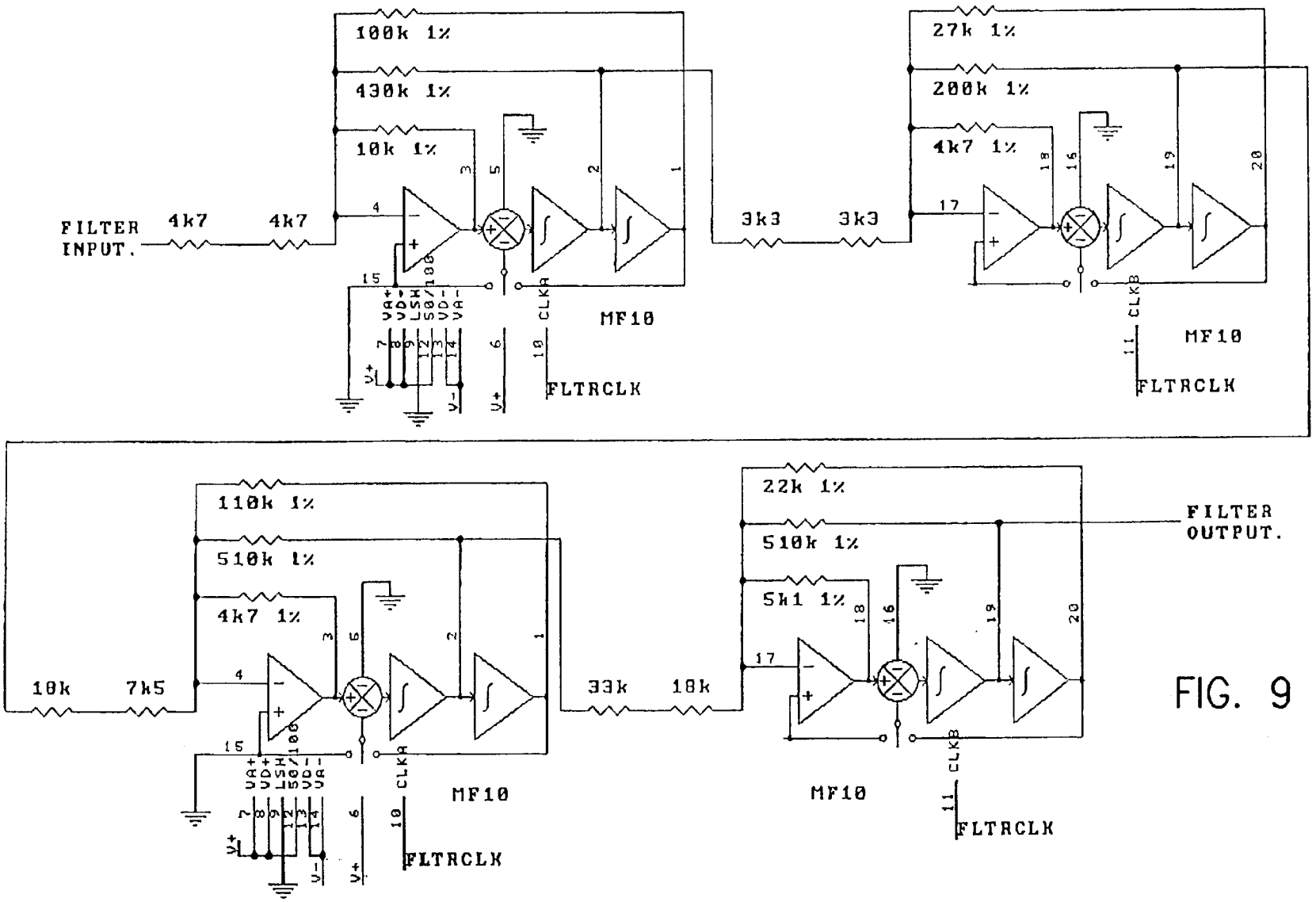
FIG. 9 is a circuit diagram of an 8th order switched capacitor bandpass filter.

A Chebyshev filter (constructed from several bandpass filters each with slightly different centre frequencies) allows a steep rolloff, and a wide bandpass, such that the bandwidth can be larger than 17 Hz and the attenuation at 250 Hz can be at least 34 dB. Thus a suitable filter, bearing in mind economic and performance factors, would be an eighth order Chebyshev bandpass filter realised using four second-order monolithic switched capacitor filters configured as bandpass filters, for example using two cascaded National Semiconductor MF10 dual switched capacitor filter ICs, as shown in FIG. 9. Switched capacitor filters offer the distinct advantage when compared with traditional active filters that filter center or cut-off frequency can be accurately controlled and is readily adjustable by controlling the clock frequency to the filter.

Figure 5:
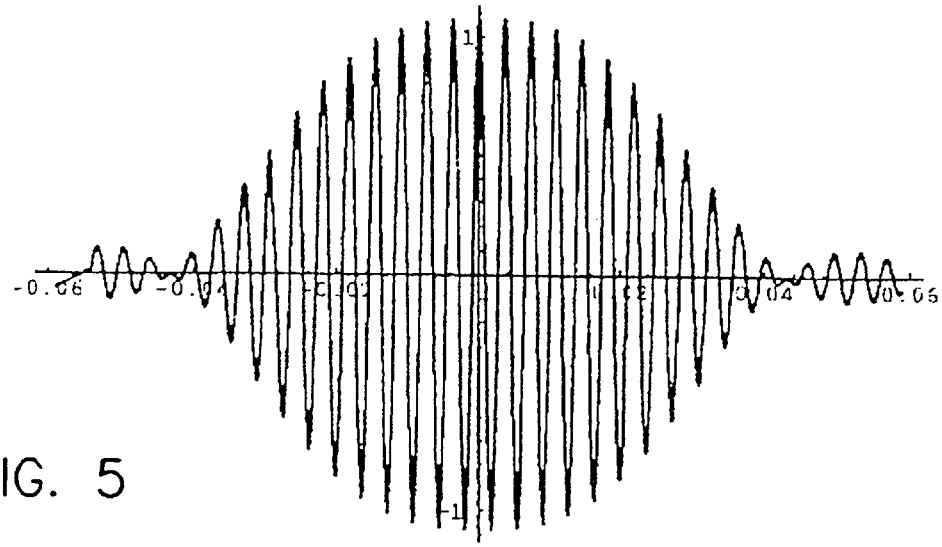
FIG. 5 is a graphical illustration of a theoretical bandpass filter output.

In a filter of this type the bandwidth is approximately equal to the inverse of the duration of the tone burst. Using a mathematical package the response of an ideal bandpass filter with bandwidth 23.5 Hz to a 17th of a second 273.07 Hz tone burst can be predicted and is shown in FIG. 5. The envelope of this filter's time domain response to a fixed amplitude tone burst is thus similar to that shown in FIG. 4(*b*). The rise time for the output of the filter is approximately half the duration of the time slot of a slave unit transmission.

If the amplitude of all of the slave unit transmissions when viewed at the master unit were constant, then this filter arrangement would be acceptable. However, replies from slave units can vary in amplitude by more than ten times with certain combinations of energizer impedance, wire impedance and system layout. As shown in the filter response graph in FIG. 5 the input signal from one time slot can spread over more than one time slot at the output. This can therefore lead to problems in detection of small amplitude signals that follow much larger amplitude signals. For example, the worst case is shown in FIG. 6.

Figure 6:
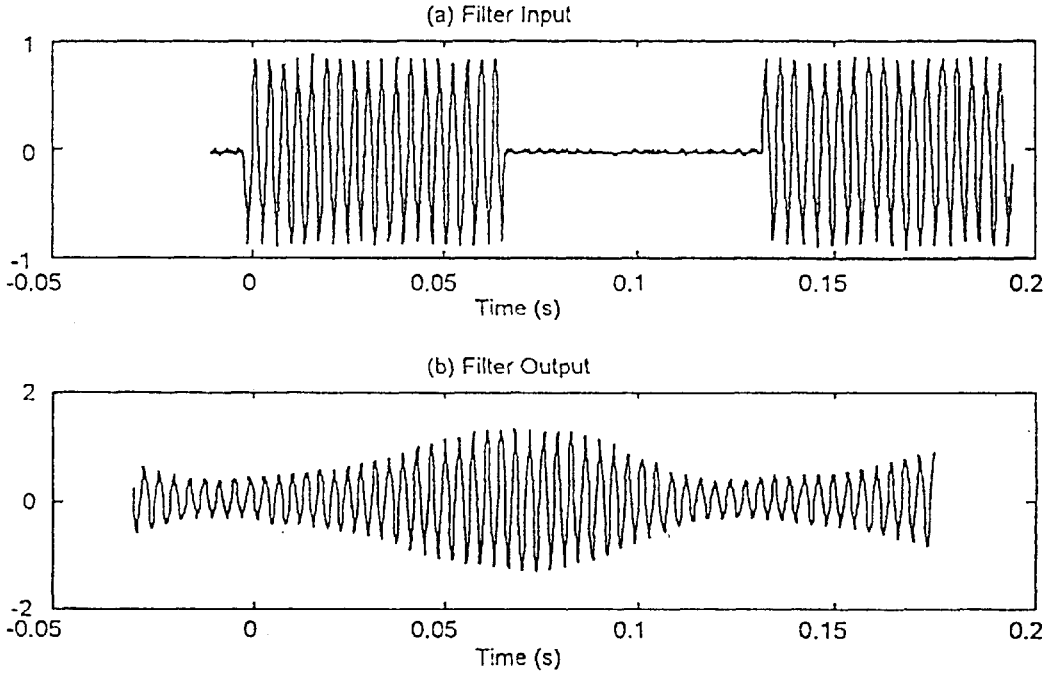
FIG. 6 is a graphical illustration of traditional filter response to tone bursts in alternate time slots.

In the case shown in FIG. 6 the filter input is shown in the upper graph and the output of a traditional Chebyshev filter shown in the bottom graph. The case shown is for alternate slave unit transmissions. The first transmission causes the "bulb" in the output. After the transmission finishes the output starts to decay but does not disappear sufficiently quickly because it can take as long as the next time slot before the transmission two time slots away starts to cause a rise in the output. Thus, the presence of a much lower amplitude transmission between the two higher amplitude transmissions would be masked by the artifact that remains in the filter from the higher amplitude transmission in the previous time slot and therefore the low amplitude transmission would not be detectable at the filter output.

According to the present invention the filter is "reset" after each time slot. As a consequence the output of the filter is set to near zero at the end of a time slot which means that a subsequent rise in the filter output during the next time slot can only be the result of a transmission in that time slot or system noise. Thus a small portion of the end of a time slot is dedicated to resetting the filter output.

According to the preferred form of the invention the filter is reset by significantly increasing the clock (FLTRCLK) frequency to each of the switched capacitor filter stages in FIG. 9.

It is possible to increase the clock frequency by approximately 40 times or more over 273 Hz (hardware specific). As a consequence this would move the pass band of the filter up to at least the 10 kHz range while keeping the Quality Factor's (Q's) of the filter stages constant. This results in a 40 times or more increase in bandwidth and thus the decay time of the filter can be greatly reduced. The signal stored in the filter at the point of changing the clock speed thus behaves as a 10 kHz or greater signal and decays quickly, whilst any input signal in the region of 273 Hz is well outside the filter's altered pass band. The filter, however, will still pass any input signals in the 10 kHz range, but these can be attenuated by including a lowpass analog (continuous time) filter prior to the switched capacitor filter stages, with its bandwidth set much greater than 273 HZ but much less than the 10 kHz.

Figure 7:
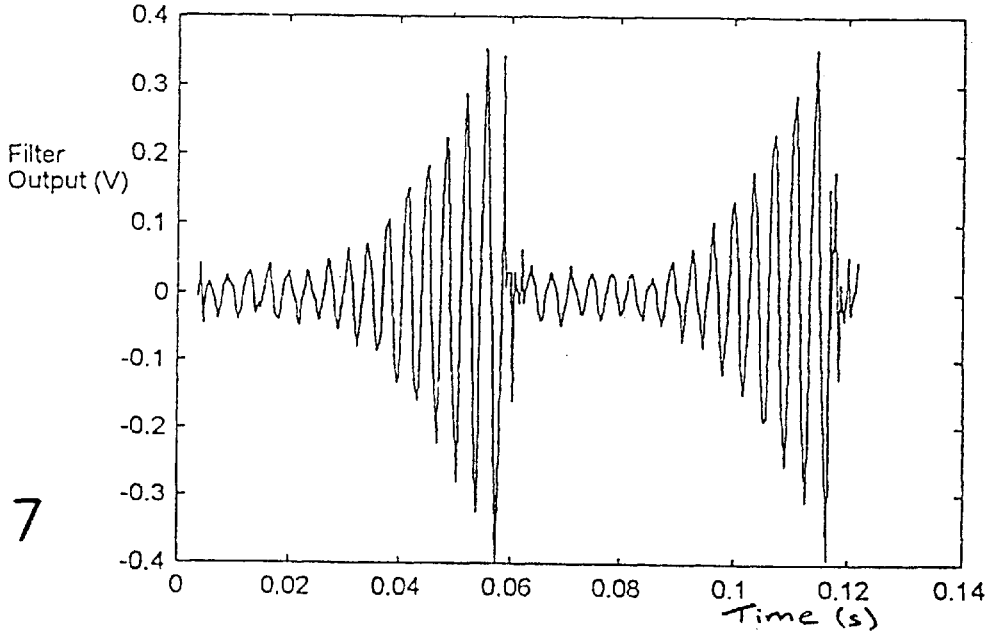
FIG. 7 is a graphical illustration of a switched capacitor filter output when fast clocking is used to reset the filter output.

Thus a small portion of the end (or beginning) of the time slot needs to be dedicated to speeding up the filter clock and "clearing out" the filter. FIG. 7 shows the response of this arrangement to two slave unit transmissions in a row. As shown, the output continues to rise until the (end of the time slot. At the end of the time slot the clock frequency is increased significantly and the output decays very quickly ready for the next time slot.

According to one form of the invention the filter clock frequency is increased up to 500 kHz in order to reset the filter. Thus the filter output envelope rises up if a response signal (tone burst) is received during the time slot, regardless of the previous time slot content. The amplitude to which the filter rises will depend upon the amplitude of the slave unit transmission as seen at the master unit.

An alternative arrangement to overcome the filter problem is to alternately (sequentially) evaluate the output from two (or more) identical parallel filters, allowing the output of the other filter(s) to settle back to an acceptable initial condition while evaluating the output of the current filter. However, this is a more costly arrangement and more space is required for the electronic hardware. Also, using two parallel filters results in slower "resetting" of the filter output than the previously described arrangement.

Note in FIG. 7 that the delay through the eighth order Chebyshev bandpass filter (approximately 20 ms at the output) increases the filter response time. According to a preferred embodiment of the present invention the signal at the output of the filter is evaluated against a symbol threshold only after first multiplying the signal by a function f(t) that applies an increasing weighting to the signal over approximately the second half of the time slot, for instance the nominally triangularly weighted function $$f(t)=0 \text{ for } t<T/2 \text{ (or thereabouts)}$$

$$f(t)=k(t-T/2) \text{ for } t>\text{or}=T/2 \text{ (or thereabouts)}$$

where T is the time slot period and k is a weighting constant.

A higher order polynomial or exponential function would also suffice.

This improvement to the symbol detection algorithm, over and above a simple amplitude-based criterion applied, to the filter output signal, makes use of the fact that most of the symbol information is present in the second half of the time slot (or thereabouts) and that the filter output signal will continue increasing until the end of the time slot for a reasonably constant amplitude signal applied at the filter's input throughout the time slot. The advantage this offers is that artifacts from the fast-clocking period at the end of the previous time slot are given zero weighting, and noise that enters or is generated in the latter stages of the switched capacitor filter does not benefit as greatly as the input signal from the weighting function applied in the second half of the time slot.

A known alternative to using a narrowband analog active filter (or pseudo-analog filter, as is the case with a switched capacitor filter) for the purpose of detecting slave unit transmissions at the master unit is to still filter the input signal in a band-limited but far less stringent fashion, then digitize it and apply a digital filter such as a matching filter to the digitized signal. However, the need then arises for a high resolution analog-to-digital converter to cope with the dynamic range of signals encountered in the pass band, and a digital signal processing IC or fast microcontroller with adequate data memory to implement the digital filter. Therefore, even today there is economic advantage in solving the problem using the previously described switched capacitor (pseudo-analog) filter with the necessary filter resetting achieved through fast-clocking of the switched capacitor filter stages.

While the foregoing disclosure has related to the invention used for communication of measured voltage on an electric fence wiring system, the method of communication could be used for the communication of any measurement or control information. While the communication method is unidirectional (from slave unit to master unit) the same method could allow transmission of control information from (a more complex) master unit to a remote control slave unit (which could also incorporate measurement capability). Slave units that measure other parameters or simply indicate status (for example, a water trough level) could possibly operate from a small level of power made available from the electric fence or could be powered from a local energy source such as storage cells and/or a solar energy generator.

What is claimed is:

1. A method of communicating information along an electric fence in an electric fence wiring system characterized by the step of communicating along the electric fence with a pulse density modulated signal.

2. A method of communication on an electric fence wiring system having an electric fence with a responder, a receiver, and an energizer coupled thereto, comprising the step of forming a complete signal in the receiver from the sum of a number of transmissions along the electric fence from the responder to the receiver over a period defined by a number of pulses from the electric fence energizer.

3. A method of communicating on an electric fence wiring system to monitor a condition of the electric fence wiring system, the method comprising the steps of:

transmitting a complete signal from a responder in the system to a receiver in the system in response to pulses from an electric fence energizer in the system during a period of time; and determining from the complete signal and from a number of the pulses from the electric fence energizer that were needed to cause the responder to transmit the complete signal, an average voltage over the period of time.

4. The method of claim 3 wherein a plurality of the responders are located at positions in the electric fence wiring system required to be monitored.

5. The method of claim 4 wherein the responders are powered from the pulses.

6. The method of claim 5 wherein responses from the responders that form the complete signal are timed to occur at different times between the pulses.

7. The method of claim 6 wherein the responders are only required to respond after having captured sufficient energy to do so.

8. The method of claim 6 wherein each of the responders sum peak voltages of the pulses until a threshold value is reached whereupon the responder responds.

9. The method of claim 8 further including the step of decoding in the receiver to determine a number of times the responders have responded within a determined number of the pulses.

10. The method of claim 9 further including the step of multiplying the threshold value by a number of positive responses from one of the responders since its first response in a complete signal measurement period until the expiry of the measurement period and dividing by the number of the pulses that have occurred since the first positive response and up to and including the last pulse that elicited a positive response from the responder within the measurement period to thereby calculate the average voltage on a fence line in the system during the measurement period.

11. The method of claim 8 wherein the summing of the impulses and instigation of the responses are software controlled.

12. The method of claim 9 including the steps of using filter means to distinguish the responses from noise on the fence line in the system and resetting the filter means to zero at the end of a transmission time slot by increasing a frequency of clock means of the filter means.

13. The method of claim 12 further including the step of multiplying and accumulating an output of the filter means by a function which applies increasing weighting substantially over the second half of the time slot prior to evaluation against a receiver threshold.

14. Apparatus for communicating information along an electric fence in an electric fence wiring system, the apparatus comprising a responder for transmitting a pulse density modulated signal along the fence, a receiver for receiving the signal from the responder, and an energizer coupled to the electric fence for providing energy pulses thereto.

15. Apparatus as claimed in claim 14, wherein said receiver is a master unit and said responder includes at least one slave unit that includes storage means for storing energy derived from the energy pulses from the energizer and transmitter means for transmitting the pulse density modulated signal.

16. Apparatus as claimed in claim 15 wherein the slave unit includes an integrator for swimming peak voltages of energy pulses and comparator means for comparing a sum of peak voltages to a threshold voltage.

17. Apparatus as claimed in claim 16 wherein the slave unit includes integration discharge means arranged to be triggered by said comparator means, said comparator means being arranged to cause the transmitter means to transmit the pulse density modulated signal.

18. Apparatus as claimed in claim 17 wherein the integrator means and integrator discharge means are implemented in software.

19. Apparatus as claimed in claim 17 wherein the master unit includes decoder means arranged to multiply the threshold voltage by a number of positive responses received from the slave unit since its first response in a complete signal measurement period until the expiry of the measurement period and to divide by the number of energizer pulses that have occurred since the first positive response and up to and including the last energizer pulse that elicited a positive response from the slave unit within the measurement period in order to obtain an average voltage on a fence line in the system during the measurement period.

20. Apparatus as claimed in claim 16 wherein the master unit includes filter means arranged to distinguish a transmission of the slave unit from noise on 9 fence line in the system.

21. Apparatus as claimed in claim 20 wherein the filter means includes one or more cascaded switched capacitor filters configured as bandpass filters.

22. Apparatus as claimed in claim 21 wherein there is provided reset means to set an output of the switched capacitor filter(s) to near zero at the end of a transmission time slot.

23. Apparatus as claimed in claim 22 wherein the reset means comprises control means to increase a clock frequency to the or each of the switched capacitor filter stages.

24. Apparatus as claimed in claim 23 wherein there is provided multiplying and accumulating means for multiplying the output of the filter means by a function which applies increasing weighting substantially over the second half of the time slot, prior to evaluation against a threshold.

25. A method of communicating along an electric fence in an electric fence wiring system incorporating an electric fence energizer, a receiver, and a responder, the method comprising the steps of forming in the receiver a complete signal from the sum of a number of transmissions from the responder to the receiver over a period of time and determining a quantity derived from the complete signal and number of pulses transmitted from the electric fence energizer to the receiver during the time period.

* * * * *